US008025347B1

(12) United States Patent
Solis

(10) Patent No.: US 8,025,347 B1
(45) **Date of Patent: *Sep. 27, 2011**

(54) MOP HOLDING DEVICE

(76) Inventor: Eduvijes Solis, Hemet, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/831,996

(22) Filed: Jul. 7, 2010

Related U.S. Application Data

(63) Continuation-in-part of application No. 12/412,326, filed on Mar. 26, 2009, now Pat. No. 7,775,611.

(51) Int. Cl.
*A47G 29/08* (2006.01)

(52) U.S. Cl. ..... 312/207; 312/206; 312/211; 312/229; 312/245

(58) Field of Classification Search ..... 206/361, 206/764, 765; 312/206, 207, 211, 229, 245, 312/351.2, 351.1; 5/614; 248/518, 519, 248/522, 125.8, 80, 97, 127, 128, 132, 161, 248/176.3, 907, 110, 313; 211/133.1, 133.4, 211/205, 207
See application file for complete search history.

(56) References Cited

U.S. PATENT DOCUMENTS

| | | | | | |
|---|---|---|---|---|---|
| 17,176 | A | * | 4/1857 | Stoner | 248/97 |
| 1,476,599 | A | | 12/1923 | De Witt | |
| 2,373,339 | A | | 4/1945 | Roberts | |
| 2,584,219 | A | | 2/1952 | Murrell | |
| 2,660,313 | A | | 11/1953 | James | |
| 2,697,646 | A | * | 12/1954 | Craig | 312/229 |
| 2,781,536 | A | * | 2/1957 | Paul | 15/257.01 |
| 2,820,685 | A | | 1/1958 | Bergholt | |
| 3,780,874 | A | | 12/1973 | Stacy, Sr. | |
| 3,834,781 | A | * | 9/1974 | Logsdon | 312/229 |
| 3,845,946 | A | * | 11/1974 | Warden et al. | 5/600 |
| 4,517,775 | A | * | 5/1985 | Engel | 52/40 |
| 4,638,910 | A | | 1/1987 | Bokmiller | |
| D296,833 | S | | 7/1988 | Slattery et al. | |
| 4,852,207 | A | | 8/1989 | Yamane | |
| 4,940,139 | A | | 7/1990 | Sandt | |
| 4,974,281 | A | | 12/1990 | Shaw | |
| 5,244,220 | A | * | 9/1993 | Cortez | 280/47.26 |
| 5,261,541 | A | | 11/1993 | Li | |
| 5,274,877 | A | | 1/1994 | Morad et al. | |
| 5,335,799 | A | | 8/1994 | Coudron | |
| 5,348,385 | A | | 9/1994 | Berg | |
| 6,036,388 | A | | 3/2000 | Atcher | |
| 6,513,889 | B1 | | 2/2003 | Park | |
| 7,775,611 | B1 | * | 8/2010 | Solis | 312/207 |
| 2005/0061695 | A1 | | 3/2005 | Nogin et al. | |

* cited by examiner

*Primary Examiner* — Mickey Yu
*Assistant Examiner* — Jenine M Pagan

(57) ABSTRACT

A mop holding device featuring a base, the front wall has a top edge and a top portion, the top portion is angled such that the top edge extends outwardly; a mop opening for receiving a pole portion of the mop disposed in the front wall; and a support bar in the inner cavity of the base for helping to support a head of the mop. A curved inner wall with a vertex is disposed in the inner cavity below the support bar, a hole is disposed in the vertex to allow passage of water out of the base. Optionally a backsplash is attached on the base, wherein a replaceable deodorizer component may be disposed on an inner surface of the backsplash. A mop holder component and/or hooks may be disposed on the base. The device may be mounted atop a stand or an expandable stand.

16 Claims, 8 Drawing Sheets

MOP HOLDING DEVICE

CROSS REFERENCE

This application is a non-provisional continuation-in-part application that claims priority to U.S. non-provisional application Ser. No. 12/412,326 filed Mar. 26, 2009, the disclosure of which is incorporated herein by reference in their entirety.

FIELD OF THE INVENTION

The present invention is directed to a device for storing mops, more particularly a mop storage device that allows for the mop to drain into a tray.

BACKGROUND OF THE INVENTION

Storing wet or damp mops in a closet can often lead to odors as well as the spreading of germs. The present invention features a mop holding device for storing mops in a clean and sanitary way. Excess water from the mop can be quickly and easily drained from the holding device. The mop holding device of the present invention may help to avoid the accumulation of odors and/or germs. The mop holding device of the present invention may help to prevent stains and/or water damage from a wet mop on a floor or against a wall.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a mop holding device. In some embodiments, the mop holding device comprises a base comprising a front wall, a back wall, and an inner cavity, the front wall has a top edge, a top portion, and a bottom portion, wherein the top portion of the front wall is angled with respect to the bottom portion such that the top edge of the front wall extends outwardly away from the back wall of the base; a mop opening for receiving a pole portion of the mop disposed in the front wall, the mop opening extends downwardly from the top edge of the front wall through the top portion of the front wall; and a support bar for helping to support a head of the mop, the support bar having a first end and a second end, wherein the first end is attached to a first side wall of the base near the top edge of the front wall and the second end is attached to a second side wall of the base near the top edge of the front wall; wherein the mop is draped over the mop opening such that the head of the mop is inserted into the inner cavity of the base and over the support bar.

In some embodiments, the mop holding device further comprises an inner wall disposed in the inner cavity of the base near a bottom area below the support bar, the inner wall is generally V-shaped or U-shaped or curved form a vertex that sequesters water that drips from a mop inside the mop holding device, wherein a hole or funnel or drain hose connector is disposed in the vertex allowing passage of said sequestered water out of the inner cavity of the base. In some embodiments, the mop holding device further comprises a removable tray for collecting water from the vertex of the inner wall in the base, the removable tray is slidably received in an aperture disposed in the first side wall, the second side wall, or the front wall of the base.

In some embodiments, the mop holding device further comprises a backsplash attached to a top edge of the back wall of the base. In some embodiments, the backsplash is pivotally attached to the base and can move between multiple positions including an open position and a closed position respectively allowing and preventing access to the inner cavity of the base. In some embodiments, the mop holding device further comprises a replaceable deodorizer component disposed on an inner surface of the backsplash.

In some embodiments, the mop holding device further comprises a plurality of ventilation holes disposed in the first side wall of the base, the second side wall of the base, the front wall of the base, or the back wall of the base, wherein the ventilation holes can help a mop that is inserted into the mop holding device to dry. In some embodiments, the mop holding device further comprises a mop holder component disposed on the first side or the second side of the base for holding a mop or broom. In some embodiments, the mop holding device further comprises one or more hooks disposed on the base.

In some embodiments, the mop holding device further comprises at least one additional mop opening to accommodate an additional mop or broom. In some embodiments, the mop holding device further comprises at least one additional support bar to accommodate the additional mop or broom.

In some embodiments, the mop holding device is mounted atop a stand. In some embodiments, the stand is an expandable stand allowing for raising and lowering of the mop holding device. In some embodiments, the expandable stand comprises telescopic poles. In some embodiments, the expandable stand is a hydraulic lift. In some embodiments, the expandable stand is a hydraulic lift, which can be operated with a remote control.

DESCRIPTION OF PREFERRED EMBODIMENTS

Figure 1:
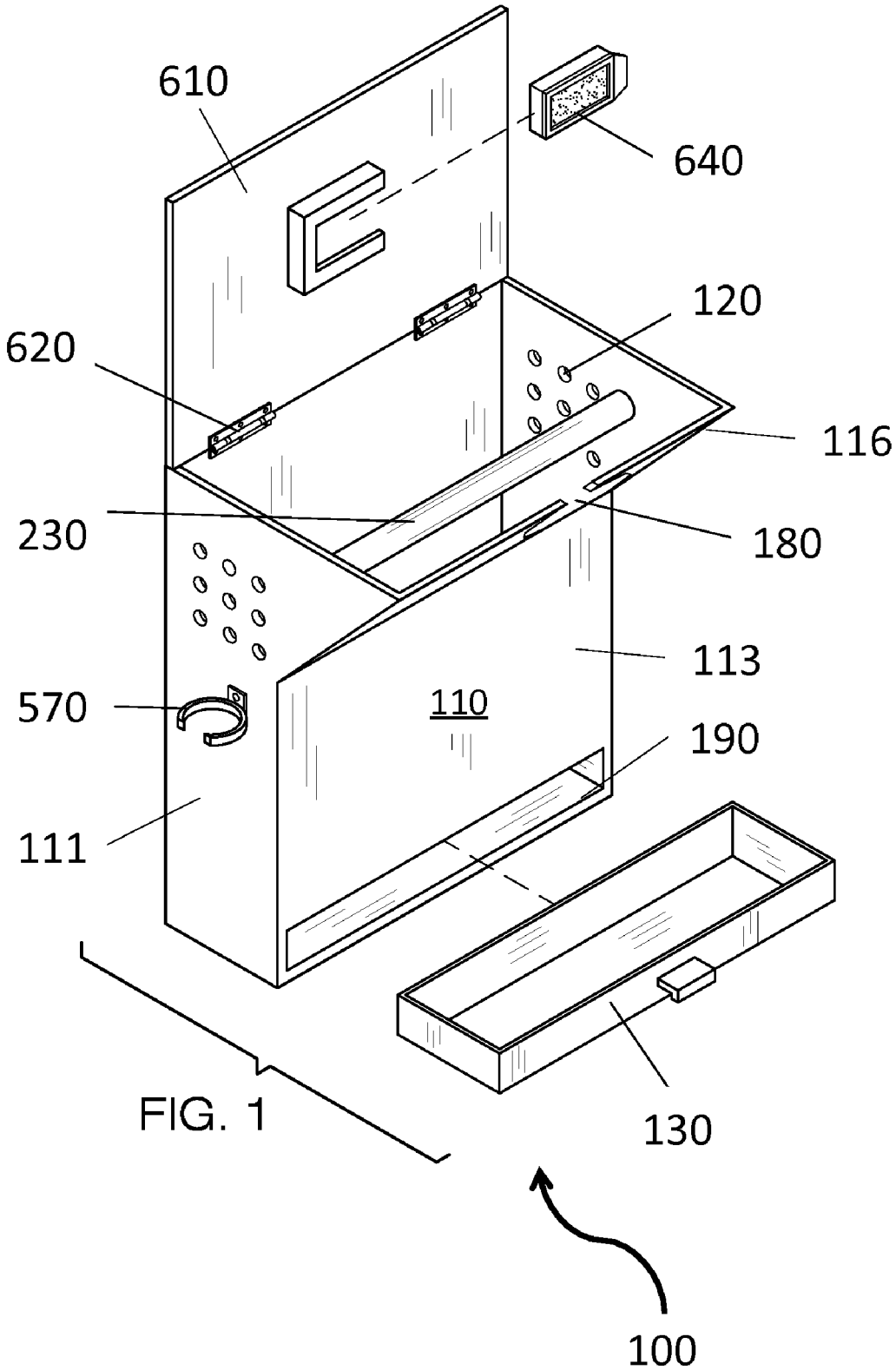
FIG. 1 is a front perspective view of the mop holding device of the present invention.

Referring now to FIGS. 1-8, the present invention features a mop holding device 100. The mop holding device 100 allows for the mop head 102 (e.g., yarn) of a mop 101 to drain. In some embodiments, the mop holding device 100 of the present invention helps to eliminate odors that typically come from damp or wet mops 101. The mop holding device 100 may be attached to a wall 350 or other similar surface. However, in some embodiments, the mop holding device may be mounted on a stand (e.g., see FIG. 6, FIG. 7, FIG. 8).

Figure 2:
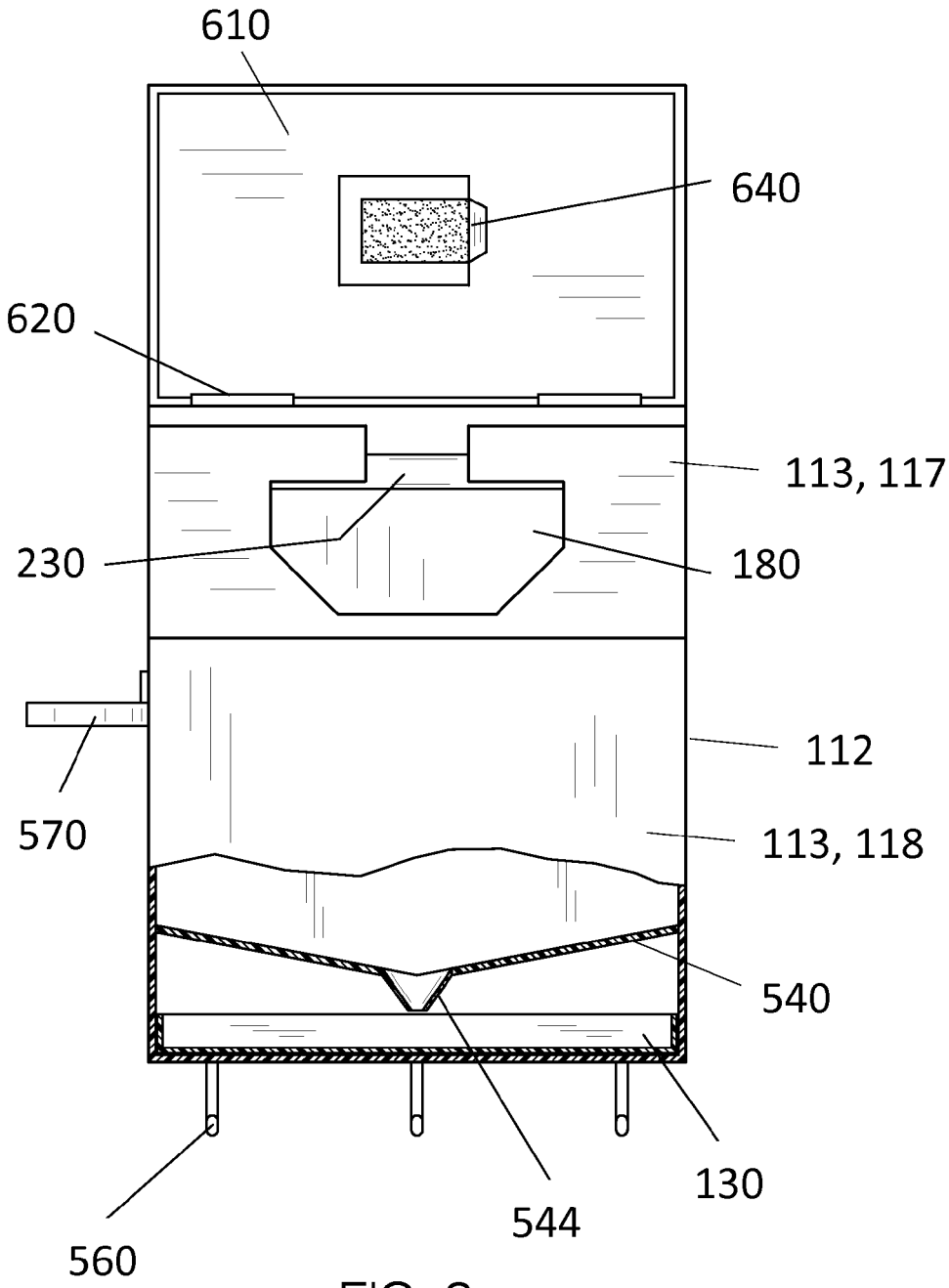
FIG. 2 is a front and internal view of the mop holding device of the present invention.
Figure 3:
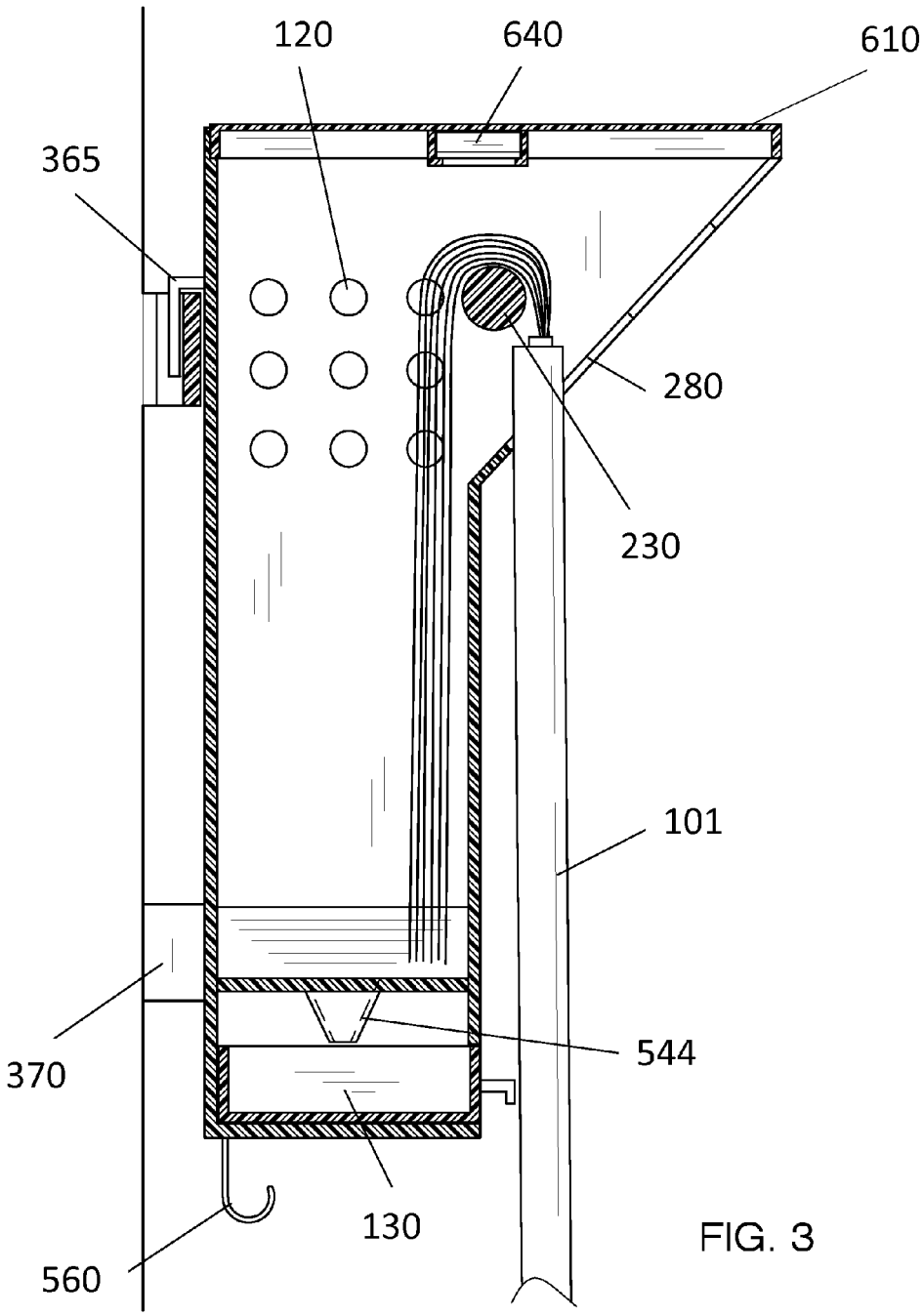
FIG. 3 is a side cross sectional view of the mop holding device of the present invention.

As shown in FIG. 1, FIG. 2, and FIG. 3, the mop holding device 100 comprises a base 110 having a first side wall 111, a second side wall 112, a front wall 113, a back wall, (optionally a bottom wall), a generally open top, and an inner cavity. In some embodiments, a plurality of ventilation holes 120 is disposed in the first side wall 111 and/or the second side wall 112 and/or the front wall 113 and/or the back wall of the base 110. The ventilation holes 120 can help allow a wet mop 101 that is inserted into the mop holding device 100 to dry. Ventilation holes may be placed elsewhere on the device 100, and in some embodiments, the device 100 does not comprise ventilation holes.

The front wall 113 of the base 110 has a top edge 116, a top portion 117 and a bottom portion 118. In some embodiments, the top portion 117 is beveled with respect to the bottom portion 118, for example the top portion 117 is angled such that the top edge 116 of the front wall 113 extends outwardly away from the back wall of the base 110 and the bottom portion 118 of the front wall 113.

Disposed in the front wall 113 of the base 110 at the top edge 116 of the front wall 113 is a mop opening 180. The mop opening 180 is for receiving the mop 101 (e.g., the pole of the mop). In some embodiments, the mop opening 180 extends from the top edge 116 of the front wall 113 downwardly through the top portion 117 of the front wall 113 toward the bottom portion 118 of the front wall 113. The mop 101 is inserted into the mop holding device 100 by placing the mop head in the inner cavity of the base 110 and hanging the pole of the mop 101 over the mop opening 180 outside of the base 110.

The mop holding device 100 further comprises a support bar 230 for helping to support the mop 101 when it is inserted into the mop holding device 100. In some embodiments, the support bar 230 has a first end and a second end, wherein the first end is attached to the first side wall 111 of the base 110 near the open top and the second end is attached to the second side wall 112 of the base 110 near the open top. In some embodiments, the first end of the support bar 230 is attached to the first side wall 111 of the base 110 near the front wall 113 of the base 110. In some embodiments, the second end of the support bar 230 is attached to the second side wall 112 of the base 110 near the front wall 113 of the base 110. In some embodiments, the first end of the support bar 230 is attached to the first side wall 111 of the base 110 about halfway between the front wall 113 and the back wall of the base 110. In some embodiments, the second end of the support bar 230 is attached to the second side wall 112 of the base 110 about halfway between the front wall 113 and the back wall of the base 110.

As shown in FIG. 3, in some embodiments, a user can insert the mop head into the inner cavity of the base 110 and over the support bar 230, while allowing the pole of the mop 101 hang over the outside of the base 110 through the mop opening 180.

As shown in FIG. 1, FIG. 2, and FIG. 3, in some embodiments, the mop holding device 100 further comprises a removable tray 130 for collecting water from the mop 101. In some embodiments, the removable tray 130 is slidably received in an aperture 190 disposed in the first side wall 111 and/or second side wall 112 and/or the front wall 113 (near the bottom of the base 110). In some embodiments, a handle 135 is disposed on the tray 130 so as to allow a user to easily slide the tray 130 in and out of the aperture 190 in the base 110. In some embodiments, the tray 130 covers a bottom wall of the base 110 (however in some embodiments, a bottom wall is not present). When a wet mop 101 is inserted into the mop holding device 100, water that drips from the mop head 102 can then be collected in the tray 130. When the tray 130 is full, a user can slide the tray 130 out to dispose of the water.

In some embodiments, a tray cover having a tray cover hole is removably attached or removably covers the tray 130. In some embodiments, the tray cover hole is disposed in the middle of the tray cover. The tray cover hole is for allowing water to enter into the tray 130 when the tray cover is atop the tray 130. In some embodiments, the tray cover is generally V-shaped or U-shaped, wherein the tray cover hole is disposed in the middle of the tray cover wherein the base of the V-shape or the base of the U-shape is located. The V-shape or U-shape allows water that drips onto the tray cover to be funneled through the tray cover hole into the tray 130.

Figure 4:
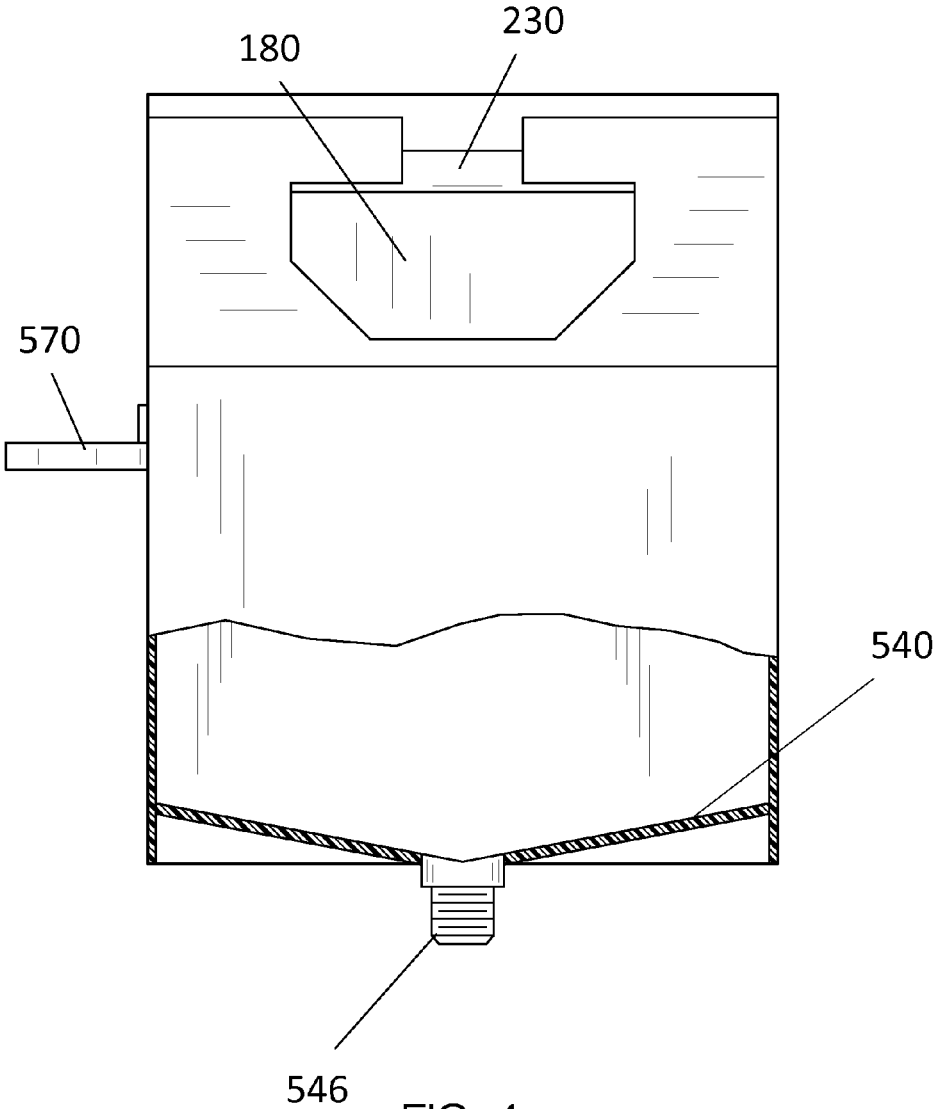
FIG. 4 is a font and internal view of an alternative embodiment of the mop holding device of the present invention.
Figure 5:
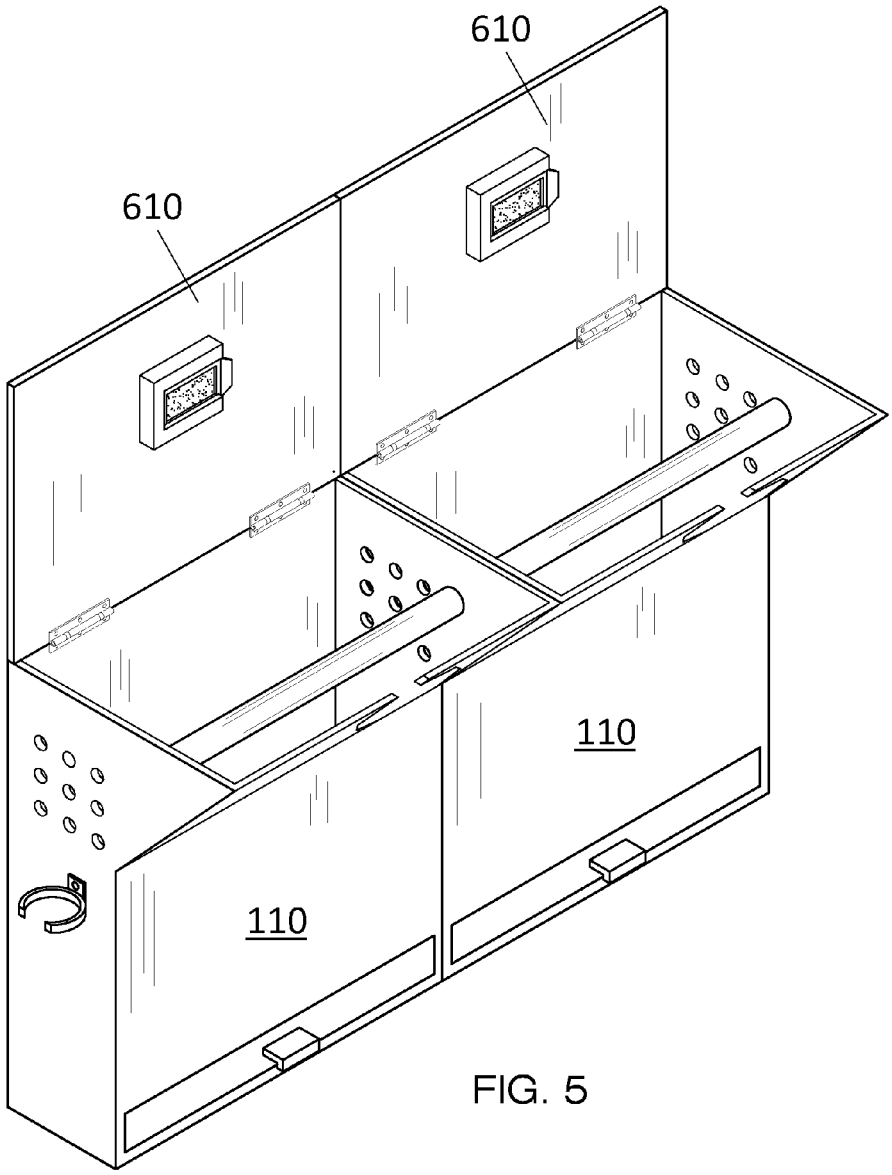
FIG. 5 is a perspective view of an alternative embodiment of the mop holding device of the present invention, wherein two mop holding devices are mounted side-by-side.
Figure 6:
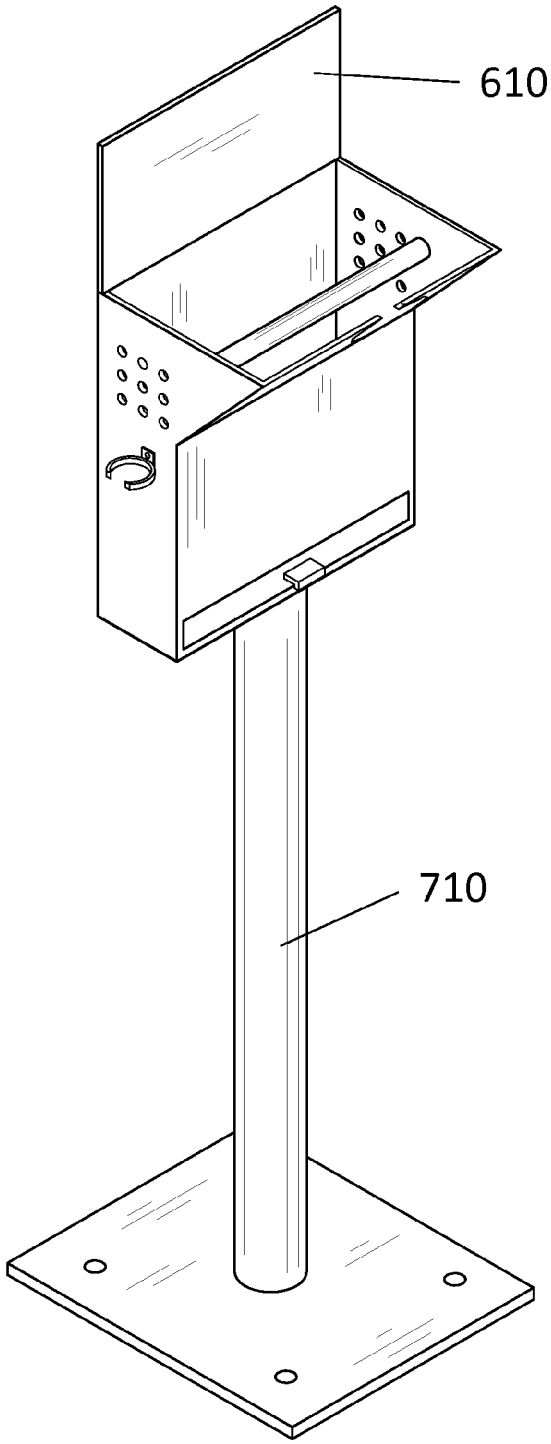
FIG. 6 is a perspective view of an alternative embodiment of the mop holding device of the present invention.
Figure 7:
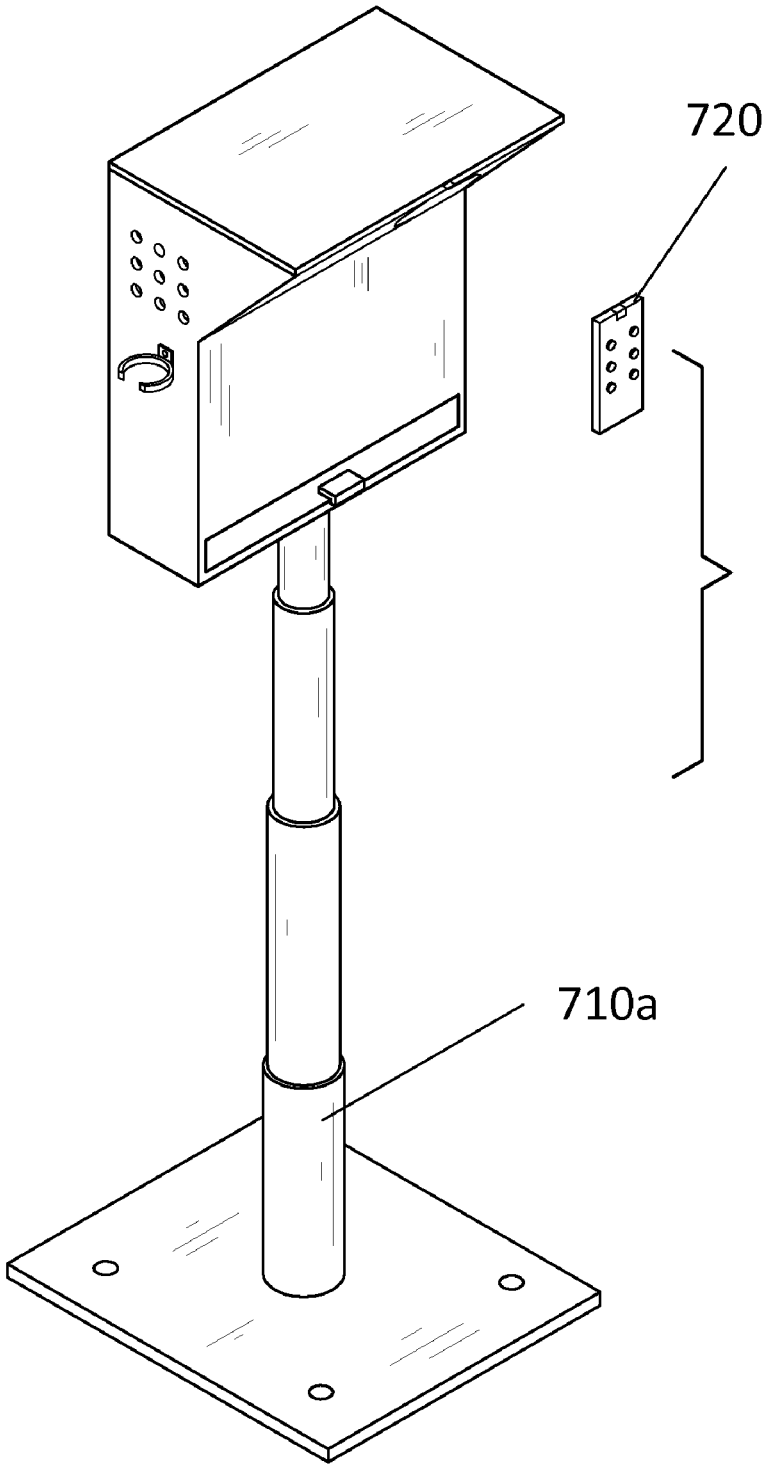
FIG. 7 is a perspective view of an alternative embodiment of the mop holding device of the present invention.
Figure 8:
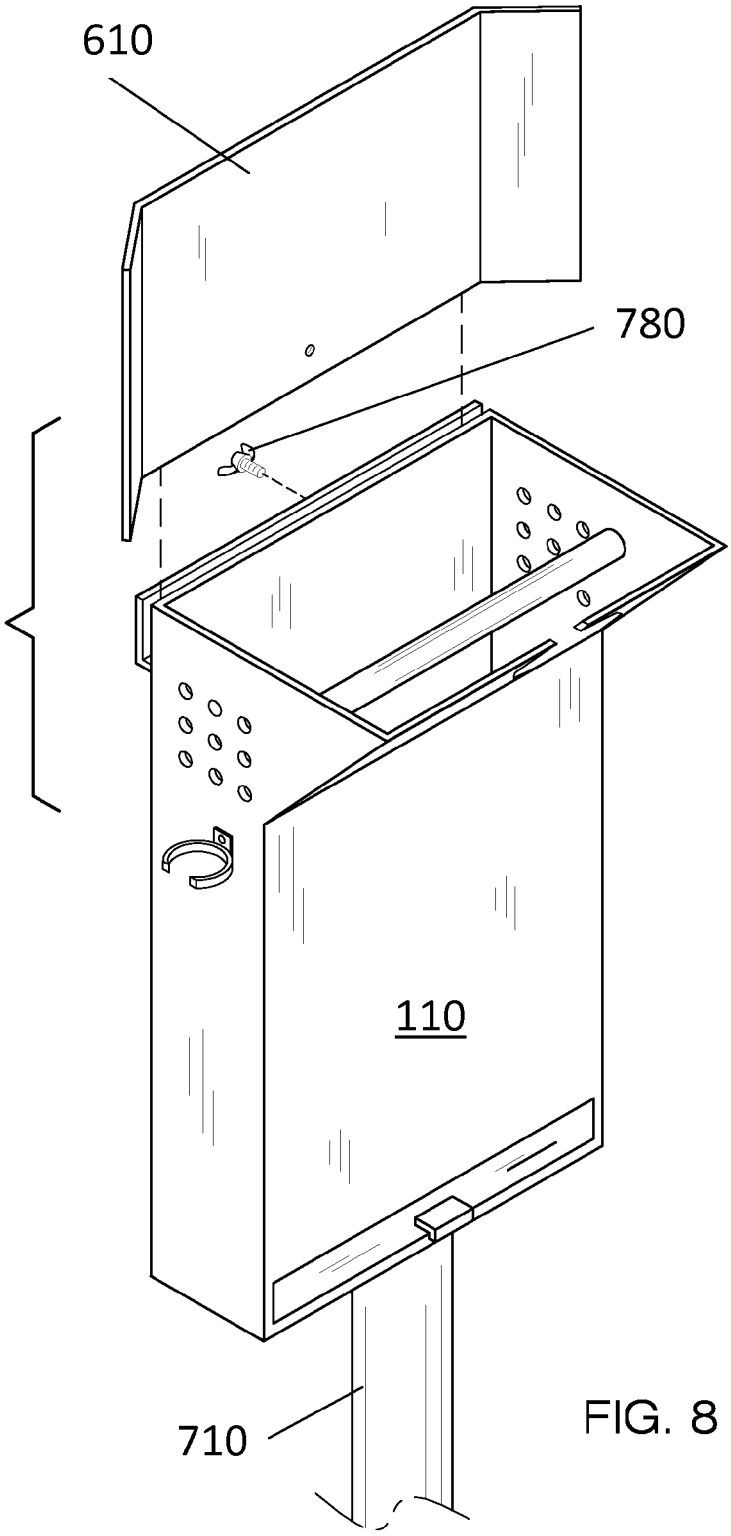
FIG. 8 is a perspective view of an alternative embodiment of the mop holding device of the present invention.

In some embodiments, an inner wall 540 is disposed in the inner cavity of the base near the bottom (see FIGS. 2-4) (e.g., below the support bar 230, etc.). The inner wall 540 may be generally V-shaped or U-shaped (or curved, etc.) to form a vertex. Water that drips from the mop 101 will be sequestered at the vertex because of the curved nature of the inner wall 540. A hole or funnel 544 is disposed in the vertex to allow passage of the sequestered water. In some embodiments, the water drains into the tray 130 (see FIG. 2, FIG. 3). In some embodiments, the water does not drain into the tray 130 (the device 100 lacks the tray 130) and instead drains to an alternative collection means, for example a lower tray (floor pan) placed on the floor below the device 100 (see FIG. 4). As shown in FIG. 4, the funnel may alternatively be a drain hose connector 546 or a nipple. In some embodiments, a drain pipe or a hose is connected to the drain hose connector 546.

In some embodiments, one or more hooks 560 are disposed on the device 100, for example on the bottom of the base 110, on a side of the base 110, on the front wall of the base 110, etc. The hooks 560 may be used for a variety of purposes including but not limited to holding other cleaning products such as brooms, rags, dust pans, etc. In some embodiments, the mop holding device comprises a mop holder component 570 (e.g., a clamp) disposed on the first side or the second side of the base 110 for holding a mop or broom (or other item with a pole). The mop holder component 570 shown in FIG. 1 is generally C-shaped and is designed to snugly hold (e.g., clamp) the pole of the mop or broom. The mop holder component 570 is not limited to the aforementioned example.

As shown in FIGS. 1-3 and FIGS. 5-8, a backsplash 610 may be disposed on the base 110, for example covering the open top of the base 110. In some embodiments, the backsplash 610 may be fixedly attached to the base 110 (see FIG. 6, FIG. 8). In some embodiments, the backsplash 610 may be removably attached to the base 110 (see FIG. 8), wherein the backsplash is removably attached to the base 110 via an attachment means (e.g., bolts and screws 780). In some embodiments, the backsplash 610 may be pivotally attached to the base 110 (see FIG. 1, FIG. 2, FIG. 3, FIG. 5, and FIG. 7), for example via one or more hinges 620. The hinges 620 may be disposed on the top edge of the back wall of the base 110, the top edge of the first side wall 111 of the base 110, or on the top edge of the second side wall 112 of the base 110. The backsplash 610 can move between multiple positions including an open position and a closed position respectively allowing and preventing access to the inner cavity of the base 110.

In some embodiments, a deodorizer component 640 (e.g., replaceable) is disposed on the backsplash 610, for example on an inner surface of the backsplash 610. The deodorizer component 640 can help to reduce odors from the wet mop 101. In some embodiments, the deodorizer component 640 is attached to the backsplash 610 via an adhesive. In some embodiments, the deodorizer component 640 is attached to the backsplash 610 via a cartridge holder (see FIG. 1). In some embodiments, the deodorizer component 640 is temporarily covered by a removable backing. The removable backing can help allow the deodorizing scent of the deodorizer component 640 to be preserved until a user is ready to use the deodorizer component 640.

The device 100 of the present invention may be expanded to accommodate more than one cleaning device (e.g., two mops, one mop and one broom, etc.). For example, in some embodiments, a single device 100 comprises two openings (180). In some embodiments, two devices 100 are installed side-by-side to accommodate multiple cleaning devices (see FIG. 5).

In some embodiments, the mop holding device 100 may be attached to a wall 350 or other similar structure. As shown in FIG. 3, in some embodiments, an attachment means is disposed on the back wall 114 of the base 110. In some embodiments, the attachment means includes a hole, a mounting hole for receiving a screw or nail, a clip, the like, or a combination thereof. In some embodiments, the attachment means is a mounting bracket clip 365 for inserting into a mounting bracket attached to a wall or similar structure (see FIG. 2).

In some embodiments, a support component 370 is disposed on the back wall of the base 110 for helping the base 110 remain stable while mounted on a wall or other similar structure. In some embodiments, the support component 370 is constructed from a material comprising a rubber, foam, a plastic, the like, or a combination thereof.

In some embodiments, the mop holding device 100 is mounted atop a stand 710, which is placed on a floor or ground surface. The stand 710 may be secured to the ground surface or floor via bolts or other securing means. In some embodiments, the stand 710 is an expandable stand 710*a*, for example a series of telescopic poles that allow for the raising and the lowering of the device 100 (see FIG. 7). In some embodiments, the expandable stand 710*a* is a hydraulic lift (e.g., operatively connected to a control panel that can function to raise and lower the device by manipulating the expandable stand 710*a*). In some embodiments, the expandable stand 710 is electronic and is operatively connected to a remote control 720, which can function to raise and lower the device by manipulating the expandable stand 710*a*. The expandability of the stand 710 may make it easier for some individuals (e.g., children or handicapped individuals) to reach.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mop holding device comprising:

(a) a base comprising a front wall, a back wall, and an inner cavity, the front wall has a top edge, a top portion, and a bottom portion, wherein the top portion of the front wall is angled with respect to the bottom portion such that the top edge of the front wall extends outwardly away from the back wall of the base;

(b) a mop opening for receiving a pole portion of the mop disposed in the front wall, the mop opening extends downwardly from the top edge of the front wall through the top portion of the front wall; and (c) a support bar for helping to support a head of the mop, the support bar having a first end and a second end, wherein the first end is attached to a first side wall of the base near the top edge of the front wall and the second end is attached to a second side wall of the base near the top edge of the front wall; wherein the mop is draped over the mop opening such that the head of the mop is inserted into the inner cavity of the base and over the support bar.

2. The mop holding device of claim 1 further comprising an inner wall disposed in the inner cavity of the base near a bottom area below the support bar, the inner wall is generally V-shaped or U-shaped or curved form a vertex that sequesters water that drips from a mop inside the mop holding device, wherein a hole or funnel or drain hose connector is disposed in the vertex allowing passage of said sequestered water out of the inner cavity of the base.

3. The mop holding device of claim 2 further comprising a removable tray for collecting water from the vertex of the inner wall in the base, the removable tray is slidably received in an aperture disposed in the first side wall, the second side wall, or the front wall of the base.

4. The mop holding device of claim 1 further comprising a backsplash attached to a top edge of the back wall of the base.

5. The mop holding device of claim 4, wherein the backsplash is pivotally attached to the base and can move between multiple positions including an open position and a closed position respectively allowing and preventing access to the inner cavity of the base.

6. The mop holding device of claim 4 further comprising a replaceable deodorizer component disposed on an inner surface of the backsplash.

7. The mop holding device of claim 1 further comprising a plurality of ventilation holes disposed in the first side wall of the base, the second side wall of the base, the front wall of the base, or the back wall of the base, wherein the ventilation holes can help a mop that is inserted into the mop holding device to dry.

8. The mop holding device of claim 1 further comprising a mop holder component disposed on the first side or the second side of the base for holding a mop or broom.

9. The mop holding device of claim 1 further comprising one or more hooks disposed on the base.

10. The mop holding device of claim 1 further comprising at least one additional mop opening to accommodate an additional mop or broom.

11. The mop holding device of claim 10 further comprising at least one additional support bar to accommodate the additional mop or broom.

12. The mop holding device of claim 1, wherein the mop holding device is mounted atop a stand.

13. The mop holding device of claim 12, wherein the stand is an expandable stand allowing for raising and lowering of the mop holding device.

14. The mop holding device of claim 13, wherein the expandable stand comprises telescopic poles.

15. The mop holding device of claim 13, wherein the expandable stand is a hydraulic lift.

16. The mop holding device of claim 15, wherein the expandable stand is a hydraulic lift, which can be operated with a remote control.

* * * * *